US005642876A

United States Patent [19]

Ferrara et al.

[11] Patent Number: 5,642,876

[45] Date of Patent: Jul. 1, 1997

[54] VARIABLE SHEET SETS STAPLING AND REGISTRATION POSITIONS SYSTEM

[75] Inventors: Joseph J. Ferrara, Webster; Stephen D. Cipolla, Fairport; William E. Kramer, Wolcott; Raymond A. Naramore; L. James Rolph, both of Webster, all of N.Y.

[73] Assignee: Xerox Corporation, Stamford, Conn.

[21] Appl. No.: 689,616

[22] Filed: Aug. 12, 1996

[51] Int. Cl.[6] ..... B65H 39/05

[52] U.S. Cl. ..... 270/58.01; 270/58.17

[58] Field of Search ..... 270/58.01, 58.17

[56] References Cited

U.S. PATENT DOCUMENTS

| | | | |
|---|---|---|---|
| 4,971,302 | 11/1990 | Morii et al. | 270/58.14 |
| 5,229,812 | 7/1993 | Toyama et al. | 270/58.08 |
| 5,398,918 | 3/1995 | Rizzolo et al. | 270/53 |
| 5,409,202 | 4/1995 | Naramore et al. | 270/53 |
| 5,443,249 | 8/1995 | Rizzolo et al. | 270/53 |
| 5,513,839 | 5/1996 | Green | 270/58.14 |
| 5,580,039 | 12/1996 | Takrhara et al. | 270/58.14 |

*Primary Examiner*—John T. Kwon

[57] ABSTRACT

In an on-line printed sheets output handling system for the sequential output by a reproduction system, in which the printed sheets are registered in neatly superposed sets which are optionally fastened together by a finishing system, which is laterally repositionable to provide variable set finishing; a lateral registration system for said printed sheets output is repositionable with said finishing system, and has a sheet registration member engaging and laterally registering the printed sheets to selectable variable lateral sheet registration positions by the finisher lateral movement repositioning system rather than a separate lateral repositioning system, with a registration disengagement system for moving the sheet registration member out of registration engagement with the sheets after a set of sheets has been laterally compiled and before the finishing system is laterally repositioned. The finishing system may comprise two staplers, one of which is fixed, and the other of which is laterally repositionable and carries the sheet registration member of the lateral registration system. This system may be integral a disk inverter stacker system.

7 Claims, 5 Drawing Sheets

VARIABLE SHEET SETS STAPLING AND REGISTRATION POSITIONS SYSTEM

Disclosed in the embodiment herein is an improvement in printed sheet output finishing systems for various reproduction apparatus, which is flexible or adaptable for different sizes of printed sheets and different desired stapling or other set finishing positions. This embodiment can provide automatically variable sheet lateral registration by a system which is integral with the repositioning of at least one of the stapler units. Thus, the same lateral movement mounting system and servo or stepper motor drive for repositioning the repositionable stapler unit can also provide for repositioning the lateral stacking registration member. In this embodiment, as shown, a variable, plural positions, stapling system and a variable set registration position system may also be integral a sheet inverting disk stacker finisher module.

Prior art of interest includes the single stapler integral disk stacker unit of either of two Xerox Corp. U.S. patents issued Apr. 25, 1995; U.S. Pat. No. 5,409,202 to Raymond Naramore and William Kramer (D/93678), and 5,409,201 to William Kramer (D/94024). Although having three sheet inverting disks rather than two, and other differences noted herein, either of these patents, and other art cited therein, may be referred to for exemplary ancillary details of a disk stacker with stapler and lateral edge tamping embodiment and thus need not be redescribed herein. Another feature is that with this exemplary system, only one stapler needs to have any movement or movement hardware or software, regardless of sheet size variations.

The prior art also includes the general idea of having two or more staplers and lateral drives for moving either of the staplers selectably at the output of a reproduction apparatus to provide different set stapling positions. For example, the Xerox Corporation "9900" duplicator—finisher, and a patent thereon, Xerox Corporation U.S. Pat. No. 4,516,714 issued May 14, 1985 to Oskar J. Braun and Lawrence C. Hubler; and also a subsequent Ricoh Corp. Japanese patent application published Jul. 31, 1995 for opposition, JP 07-69640-B4, filed Oct. 28, 1986.

Of interest in regard to process direction registration members movable with or by a stapling head is U.S. Pat. No. 5,398,918 issued Mar. 21, 1995 by Charles D. Rizzolo, et al (D/92331C) (see especially FIG. 6); and U.S. Pat. No. 5,443,249 issued Aug. 22, 1995 to Charles D. Rizzolo, et al (D/92331i).

The disclosed embodiments may be alternatively usable in a system of on-line selectable hole punching or other finishing of printed sheets of paper or the like being outputted by a copier or printer, which could also be simple, low cost, and compact, and likewise can be integrated within the existing space of an inverter/stacker type sheet output system. Some copiers have begun to offer on-line hole punching of the sheets during or immediately after the printing process in the copier, so that conventional unpunched blank copy sheet stock may be utilized, yet provide appropriately punched print jobs in the output. Also, it has been suggested in prior patents. Noted, for example, is Xerox Corporation U.S. Pat. No. 4,819,021 issued Apr. 4, 1989 to Michael S. Doery, noting particularly the left-hand sides of FIGS. 3 and 4 and Col. 8; and U.S. Pat. No. 4,575,296; U.S. Pat. No. 4,763,167; U.S. Pat. No. 5,508,799; and U.S. Pat. No. 4,988,030. These references also note that on-line hole punching can be provided with or without stapling or other set binding in addition thereto.

Further advantages of the disclosed embodiment, as will be apparent, include ease of tech rep, operator or user adjustability of the position and/or number of finishing positions in the sheet, as well as automatic features as disclosed. It will also be appreciated that the ability to utilize the various advantages of the existing disk stacker/inverter components is one of the advantages of the disclosed embodiment.

A specific feature of the specific embodiments disclosed herein is to provide in an on-line printed sheets sets output handling system and finishing system for the printed sheets sequentially outputted by a reproduction system, in which the printed sheets are registered and compiled in neatly superposed sets which are optionally fastened together by said finishing system, and wherein said finishing system is laterally repositionable by a finisher lateral movement repositioning system to provide variable set finishing; a sheet lateral registration system for said printed sheets output which is repositionable with said finishing system, said sheet lateral registration system having a sheet registration member for engaging and laterally registering said printed sheets for said registration and compiling, said sheet lateral registration system having a lateral repositioning system providing movement of said sheet registration member to selectable variable lateral sheet registration positions, said lateral repositioning system of said sheet lateral registration system being provided by said finisher lateral movement repositioning system rather than a separate lateral repositioning system.

Further specific features disclosed herein, individually or in combination, include those wherein said sheet lateral registration system has a registration disengagement system for moving said sheet registration member out of registration engagement with said sheets after a set of sheets has been laterally compiled and before said finishing system is laterally repositioned by said finisher lateral movement repositioning system; and/or wherein said finishing system comprises two staplers, one of which is fixed, and the other of which is repositionable by being mounted for lateral movement by said finisher lateral movement repositioning system; and wherein said lateral registration system is operably connected to move laterally with said repositionable stapler; and/or including a sheet tamping system for tamping the opposing lateral edge of a sheet being laterally registered against said sheet registration member of said lateral registration system; and/or in which said finishing system provides a selection between single corner stapling of the set and correctly spaced dual stapling of the set, and wherein said sheet registration member of said lateral registration system is closely spaced from said laterally repositionable stapler by a distance providing correct set registration for said corner stapling; and wherein said sheet lateral registration system has a registration disengagement system for moving said sheet registration member out of registration engagement with said sheets after a set of sheets has been laterally compiled thereagainst and before said repositionable stapler is laterally repositioned by said finisher lateral movement repositioning system into said dual stapling position; and/or further comprising a rotatable disks type sheet inverter and stacker, in which the printed sheets being outputted are individually rotated for inversion before being released for stacking while being at least partially held in said rotatable disks; wherein said lateral registration system sheet registration member laterally registers said printed sheets individually as said sheet is being at least partially held and rotated by said disks; and further including a tamping system for tamping the laterally opposing edge of the sheet being laterally registered towards said sheet registration member while said sheet is being at least partially held and rotated by said disks.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. Conventional sheet path sensors or switches connected to the controller may be utilized for sensing, counting, and timing the positions of sheets in the sheet paths, and thereby also controlling the operation of sheet feeders and inverters, etc., as is well known in the art.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of a specific embodiment, including the drawing figures (approximately to scale) wherein:

Figure 1:
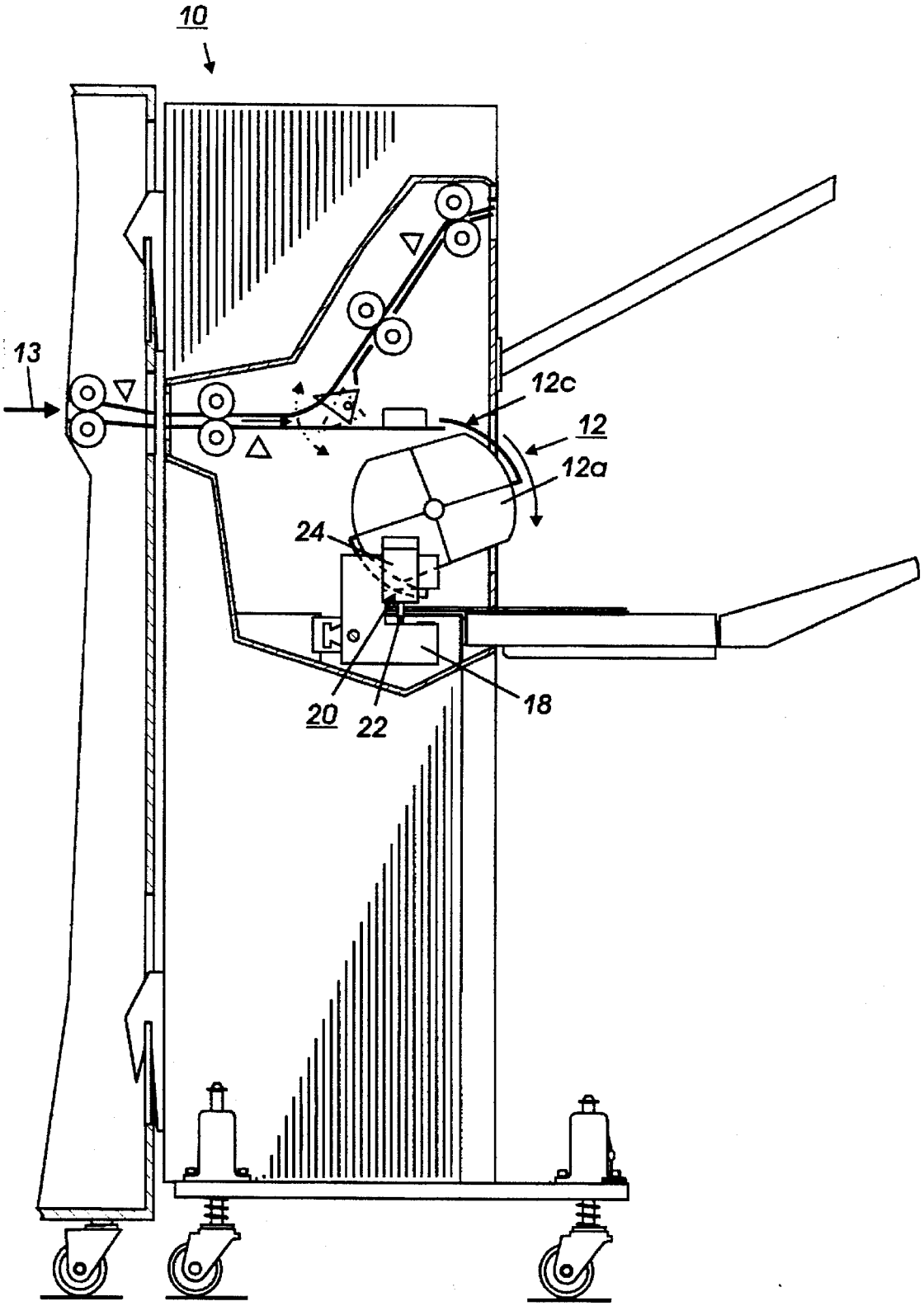
FIG. 1 is a schematic side view of one example of an integral variable stapling and registration system integral an inverter/stacker output system, at the output of a sheet printing system.
Figure 2:
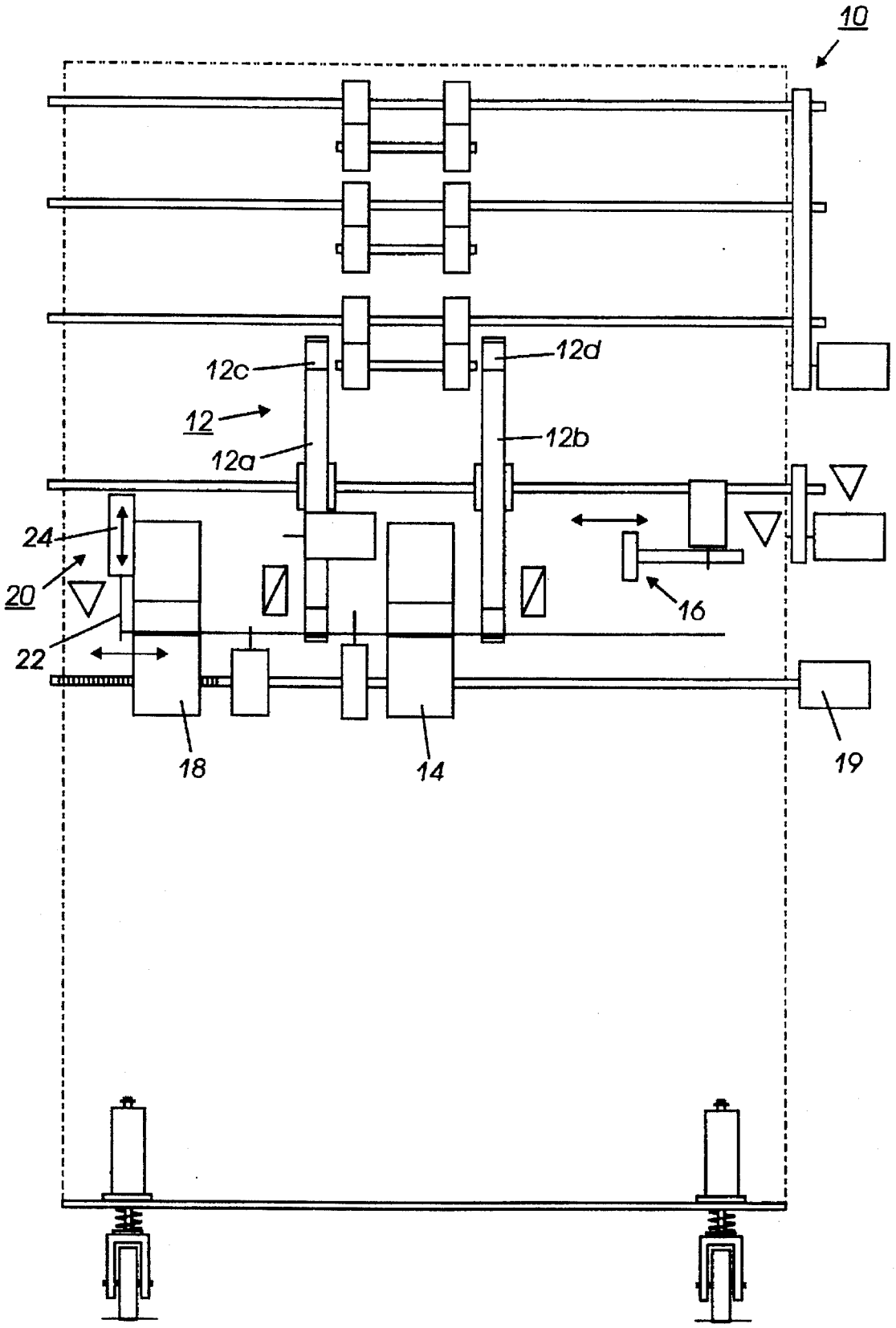
FIG. 2 is a schematic end view of the embodiment of FIG. 1.

As noted, in this illustrated example, an output sheets stacker-finisher module system 10 is shown which is similar in many respects to said above cited U.S. Pat. Nos. 5,409,202 or 5,409,201 to the same Raymond Naramore and William Kramer. That is, a disk stacker 12 with rotatable disks like 12*a* and 12*b* for sequentially receiving in their slots 12*c* and 12*d*, and inverting by their rotation, the sheets from a printer or copier output path 13. As described there, a sheet enters the disks 12*a* and 12*b* via input feed nips. The disks may then accelerate to process speed just as the sheet buckles in the disk slots 12*c* and 12*d*. This is timed from a sensor. The disks then rotate together to escort the sheet to the registration edge in the process direction. The sheet is deskewed and registered in the process direction, and also is tamped laterally into lateral registration. The disks then accelerate around to their next home position. The disks then stop in their home position, awaiting the next sheet. The next sheet then enters, as previously described. These steps are repeated until a full set of sheets is compiled, and then the compiled set is stapled. The process direction (inside) registration edge is then actuated to push the set all of the way out on to the elevator stacking tray. A hold down finger assist may be laid on top of the previously ejected stacked sets during this last step.

These parents also show and describe one integral fixed position stapler such as 14 here and a lateral edge tamping system generally such as 16 here, which thus need not be redescribed herein.

However, if may be seen that here the fixed stapler 14 is in a different position, and that here there is a variable dual stapler system, with another, laterally repositionable, stapler 18, to allow either corner stapling or dual position edge stapling or no stapling. Also, here there are only two centrally located but spaced apart sheet inverter disks 12*a* and 12*b* in this dual stapler system. (Only two disks are needed by using a center registered type output 13 and/or reproduction machine, in which all sheets are outputted centrally, regardless of size). One of the two staplers, 14 here, is a fixed position stapler mounted in a fixed position between these two central disks 12*a* and 12*b*. The other stapler 18 is outside of and to the left of the two disks (towards the front of the module). This second stapler unit 18 is a unit movable laterally of the sheet output path, preferably automatically laterally repositionable by a servo system 19 along a mounting track, so as to provide either proper position corner stapling or a second side staple in the proper position for output sheet sets of various sizes. In this disclosed system, only this one stapler 18 needs to have any movement, movement hardware or software, regardless of sheet size variations.

Figure 3:
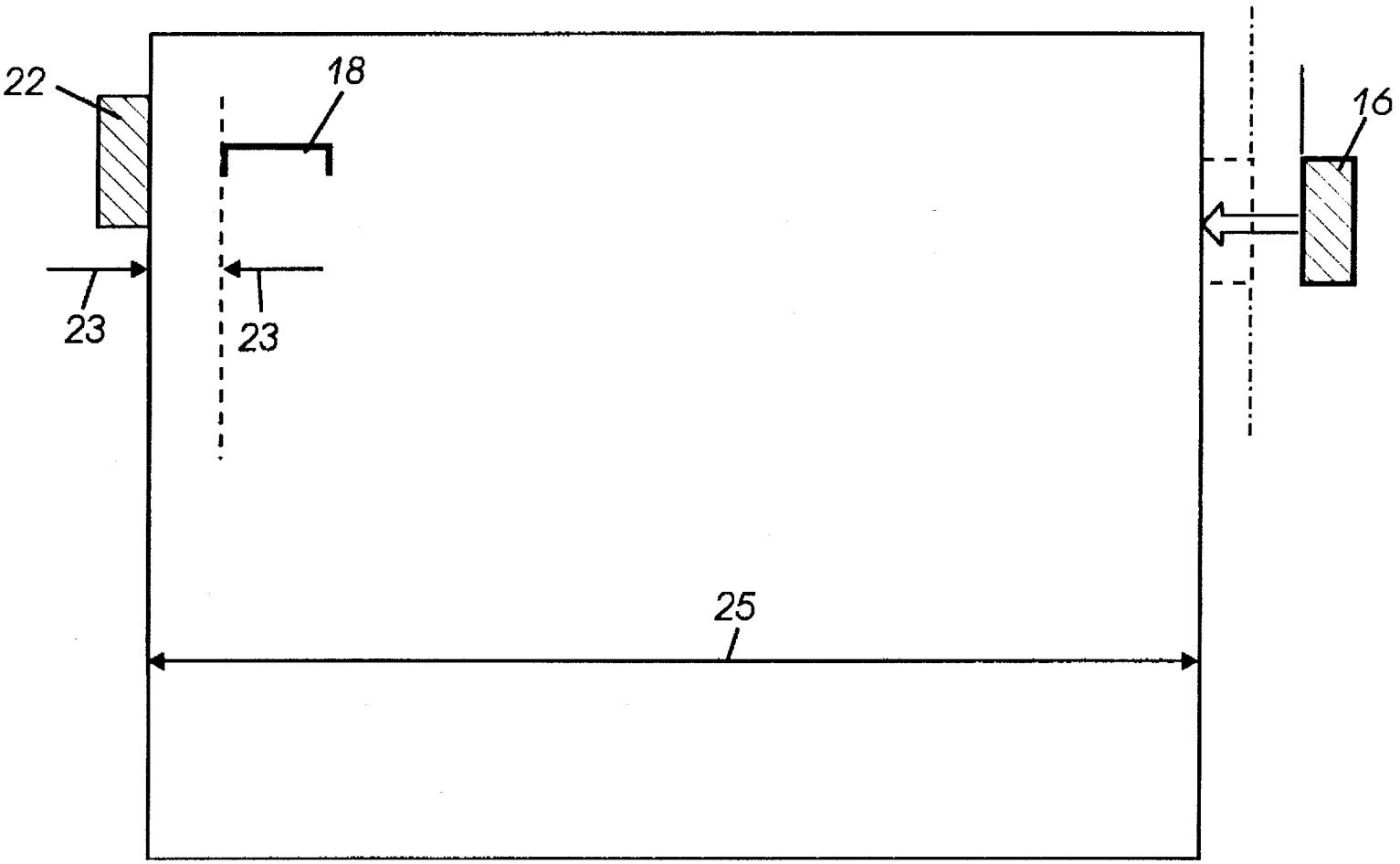
FIG. 3 shows in a partial top view the stapling and registration positions for corner stapling with this same embodiment for an exemplary sheet set.

Here there is also a novel variable lateral stapling sheets end position registration system 20 which is compatible with the variable tamping system 16, which registration system 20 is integrally associated with this second stapler unit 18 and movable (laterally resettable) therewith. The second stapler 18, which is movable, is integral a moving mechanism which has an integral retractable side registration edge or finger 22 for registering sheets prior to stapling. This registration edge 22 works in conjunction with tamping mechanism 16 to accomplish cross-process registration. Each sheet here is tamped against registration finger 22. The movable stapler 18 and the side registration edge 22 are positioned based on paper size and stapling mode via a servo or stepper motor system such as 19. They are repositioned as required for the dual stapling mode and for paper size changes between sets. The registration finger 22 thereof is mounted a small fixed distance laterally outside of the jaws of the second, movable, stapler 18. When corner stapling is selected, as in FIG. 3, the preset spacing distance 23 between the finger 22 and the stapling position outside edge (e.g., 6 mm) provides the proper spacing for proper corner stapling from the registered edge of the compiled set of sheets with this second stapler 18, irrespective of the stapler 18 position or the sheet size, e.g., paper width 25 here. The dot-dashed line at the right side of FIG. 3 illustrates the nominal edge position of that side of the sheet upon its entry by the disks before tamper 16 tamps, as shown by its movement arrow. The solid line positions show the sheet edges after tamping.

For single, corner, stapling, and for unstapled stacking, the stapler mechanism 18 and its integrated retractable side registration edge 22 is positioned based on the paper path centerline and the paper width.

Figure 4:
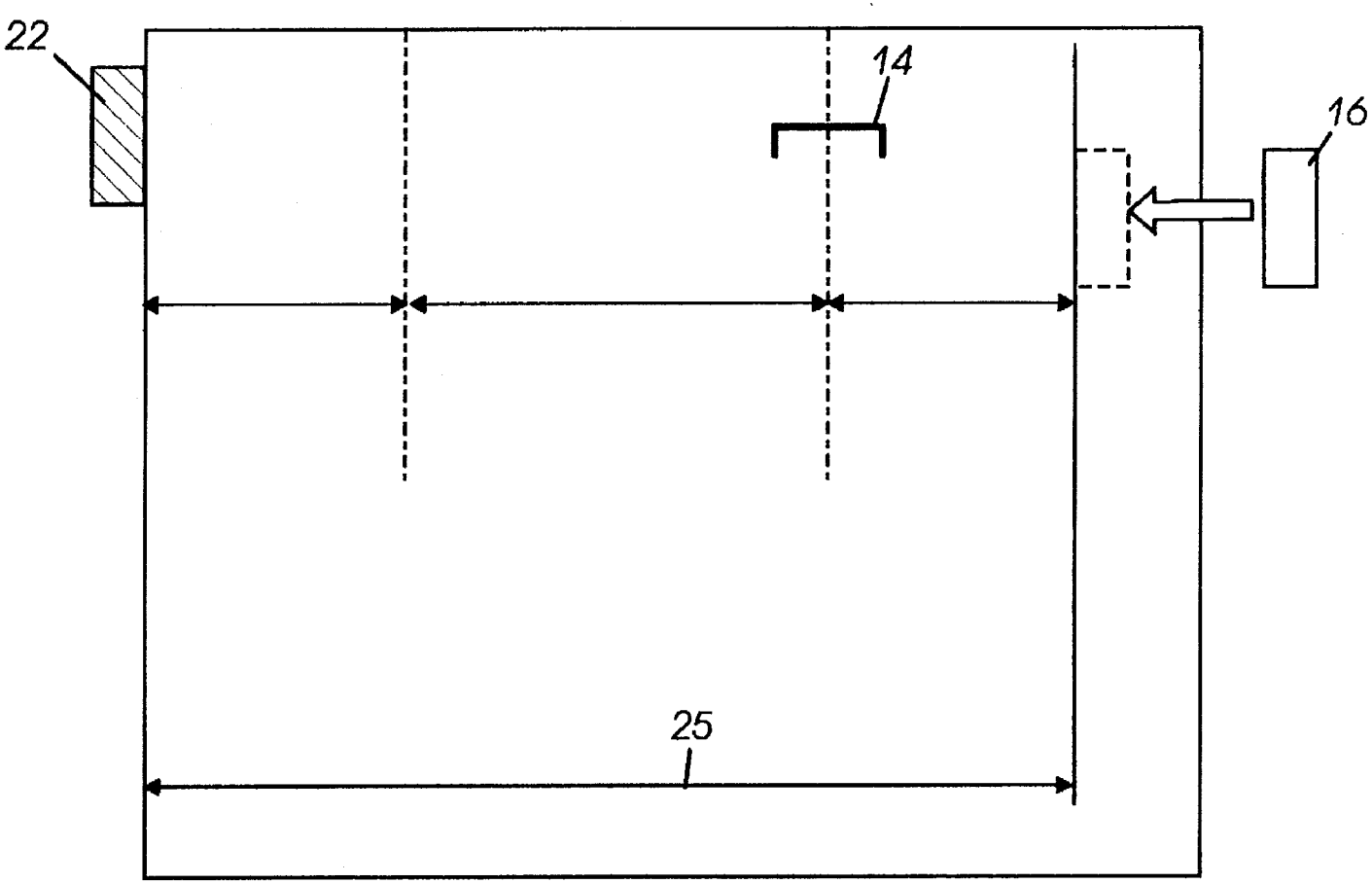
FIG. 4 shows a similar top view with a different registration position for dual stapling with the same embodiment on a set of sheets.
Figure 5:
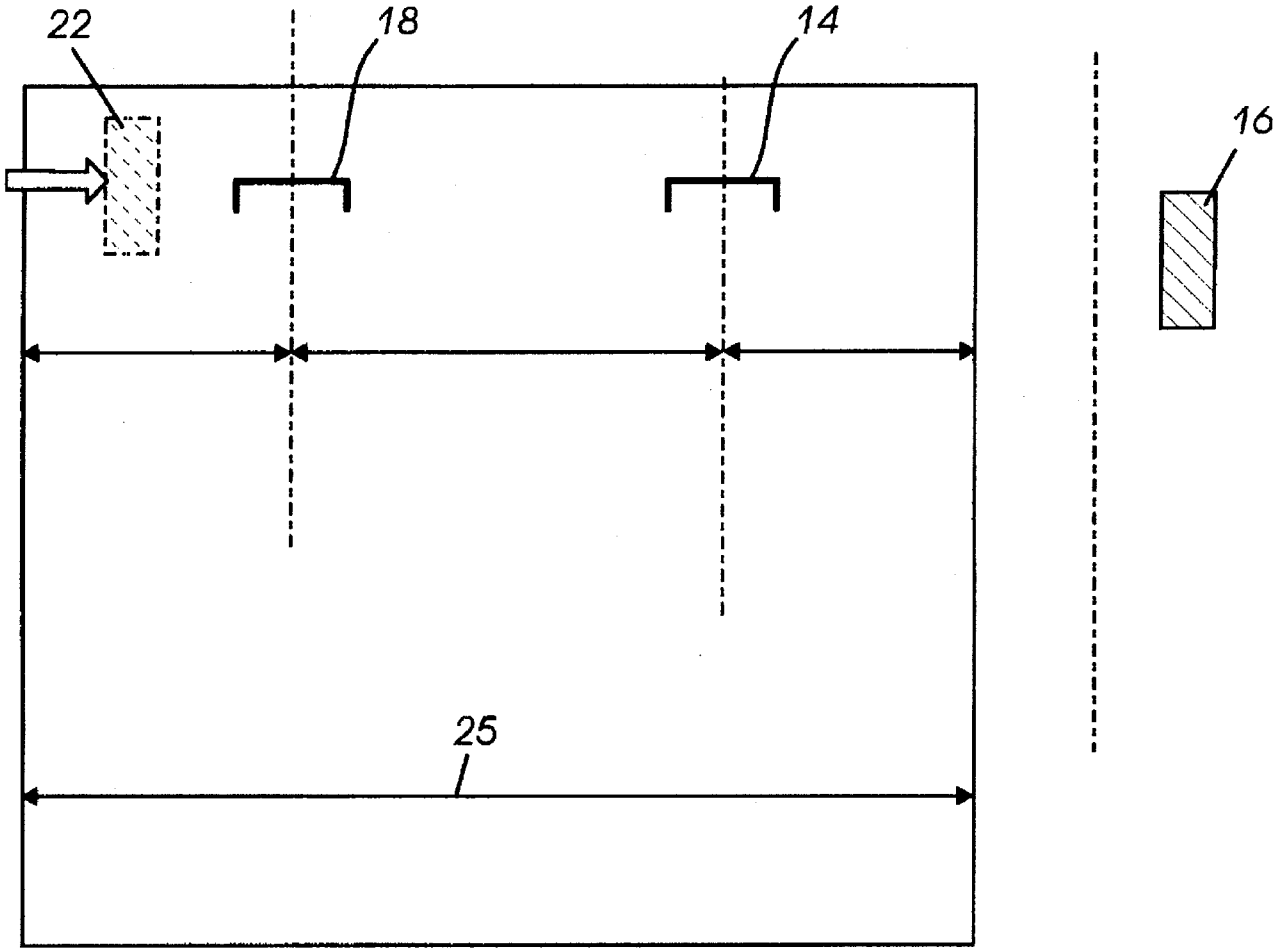
FIG. 5 is the view of FIG. 4, showing the exemplary dual stapling positions for this embodiment.

When the second stapler 18 is to be instead used together with stapler 14 in a dual staples edge stapling mode instead of single corner stapling, the set is registered as shown in FIG. 4, and then as shown in FIG. 5, the stapler unit 18 is desirably moved in to approximately 25% of the sheet lateral dimension in from the lateral edge registration position of the sheets by stepper or servo motor system 19. For this two staples mode, before this lateral stapler 18 movement, a solenoid 24 lifts this fixed registration edge finger 22 up out of the way of all the sheets. The second stapler 18 can then be moved laterally toward the first stapler into the proper position for said dual edge stapling, as shown in FIG. 5, without disturbing the set with the registration finger 22 (shown in phantom in FIG. 5 where it is lifted out of the way). However, the finger 22 is only so moved up out of its sheet registration position after the full set of the sheets to be stapled together have all been compiled and tamper 16 registered against this registration finger 22, just as for comer stapling above, but in the position shown in FIG. 4.

The tamper 16, which tamps the opposite edge of the sheet from said lateral registration edge finger 22 towards that finger 22, is adapted to accommodate various sizes of sheets and to tamp each incoming sheet against this registration finger 22, without overtamping force. This is preferably done while each sheet is still being at least partially supported in the disk slots 12*c* and 12*d*, as in the above-cited patents.

To express this in other words, this retractable side registration edge mechanism 20 is attached to the moving stapler 18 frame. The registration edge 22 is appropriately located with respect to the proper staple position for single stapling. For dual stapling, the registration edge is differently positioned for proper cross-process registration for that mode. The registration location varies with paper size and is based on the desired second staple position. The stapler 18 is then repositioned, after the set has been compiled, for the dual stapling function by ¼ of the paper width 25. To reexpress this, for dual stapling, the movable stapler 18 with the retractable side registration edge 22 is initially positioned based on the location of the fixed stapler 14 and based on the paper width 25. The registration edge 22 is initially positioned at ¾ of the paper width from the centerline of the fixed stapler 14, as shown in FIG. 4.

In both modes, the stapling function occurs after the tamping function is completed for the last sheet of a set. The stapler cycle is initiated after the last tamp is complete and preferably just after a safety guard is put in place. The stapler(s) drive the staple in the set edge and then the set is ejected.

For dual stapling, the stapler function may differ slightly. After the tamping function is completed for the last sheet of the set, the fixed stapler 14 cycle is initiated just after its safety guard is in place. The retractable side registration edge 22 is lifted out of the way just after the fixed stapler 14 cycle has started. The movable stapler 18 is then repositioned to the proper stapling position. Then its stapling cycle is initiated just after its safety guard is in place. The set is then ejected.

It may be seen that the same lateral movement and mounting system for this second stapler unit also provides for lateral positioning of the stacking registration finger 22. That is, the second stapler unit 18 with its integral registration finger 22 may be initially positioned in the desired edge registration system 20 position by stepper system 19 for the particular sheet size of the set. This set registration positioning may be automatic, from information provided by the printer controller and/or sensors in its sheet output or the module 10 input. The same servo drive 19 for this second stapler unit 18 thus also provides for servo positioning of the lateral stacking position controlling registration finger 22. That is, the second stapler unit 18 with ifs integral registration finger is positioned for the desired edge registration position for stacking that set. Then, if stapling elsewhere than that set's corner is desired, the same movement mechanism can reposition the same stapling unit elsewhere relative to the set, after lifting finger 22 out of the way by solenoid 24.

With this system, only one stapler 18 needs any movement or movement hardware or software, regardless of sheet size variations. The other stapler 14 can remain fixed. Yet, the stapling positions of both staplers relative to the set can be varied widely, by resetting the finger 22 registration position during compiling of the set, and/or resetting the (independent) stapling position of the movable stapler 18.

The present system is also usable for and compatible with alternate sets partial offsetting, by different lateral registration compiling positions, which is well known in sheet output systems. E.g., Xerox Corp. U.S. Pat. No. 5,501,442 issued Mar. 26, 1996 to Barry P. Mandel (D/93391i) shows an integral dual mode set tamping or set offsetting system.

Although the above is described using as an example said U.S. Pat. No. 5,409,202 disk stacker, it will be appreciated that this is merely one example and that other stackers, tampers, and registration systems are known.

While the embodiment disclosed herein is preferred, it will be appreciated from this teaching that various alternatives, modifications, variations or improvements therein may be made by those skilled in the art, which are intended to be encompassed by the following claims:

We claim:

1. In an on-line printed sheets sets output handling system and finishing system for the printed sheets sequentially outputted by a reproduction system, in which the printed sheets are registered and compiled in neatly superposed sets which are optionally fastened together by said finishing system, and wherein said finishing system is laterally repositionable by a finisher lateral movement repositioning system to provide variable set finishing;

the improvement comprising:

a sheet lateral registration system for said printed sheets output which is repositionable with said finishing system, said sheet lateral registration system having a sheet registration member for engaging and laterally registering said printed sheets for said registration and compiling, said sheet lateral registration system providing movement of said sheet registration member to selectable variable lateral sheet registration positions, said sheet registration member being repositioned by said finisher lateral movement repositioning system.

2. The on-line printed sheets sets output handling system and finishing system of claim 1, wherein said sheet lateral registration system has a registration disengagement system for moving said sheet registration member out of registration engagement with said sheets after a set of sheets has been laterally compiled and before said finishing system is laterally repositioned by said finisher lateral movement repositioning system.

3. The on-line printed sheets sets output handling system and finishing system of claim 1, wherein said finishing system comprises two staplers, one of which is fixed, and the other of which is repositionable by being mounted for lateral movement by said finisher lateral movement repositioning system; and wherein said lateral registration system is operably connected to move laterally with said repositionable stapler.

4. The on-line printed sheets sets output handling system and finishing system of claim 1 including a sheet tamping system for tamping the opposing lateral edge of a sheet being laterally registered against said sheet registration member of said lateral registration system.

5. The on-line printed sheets sets output handling system and finishing system of claim 1 in which said finishing system comprises two staplers, one of which is mounted in a fixed position and the other of which is laterally repositionable by said finisher lateral movement repositioning system to provide a selection between single corner stapling of the set and correctly spaced dual stapling of the set, and wherein said sheet registration member of said lateral registration system is closely spaced from said laterally repositionable stapler by a distance providing correct set registration for said corner stapling; and wherein said sheet lateral registration system has a registration disengagement system for moving said sheet registration member out of registration engagement with said sheets after a set of sheets has been laterally compiled thereagainst and before said repositionable stapler is laterally repositioned by said finisher lateral movement repositioning system into said dual stapling position.

6. The on-line printed sheets sets output handling system and finishing system of claim 1, further comprising a rotatable disks type sheet inverter and stacker, in which the printed sheets being outputted are individually rotated for inversion before being released for stacking while being at least partially held in said rotatable disks; wherein said lateral registration system sheet registration member laterally registers said printed sheets individually as said sheet is being at least partially held and rotated by said disks; and further including a tamping system for tamping the laterally opposing edge of the sheet being laterally registered towards said sheet registration member while said sheet is being at least partially held and rotated by said disks.

7. The on-line printed sheets sets output handling system and finishing system of claim 6 in which said finishing system comprises two staplers, one of which staplers is mounted in a fixed position between said disks, and the other stapler is repositionable by being mounted laterally outside of said disks for lateral movement by said finisher lateral movement repositioning system, and wherein said lateral registration system is operably connected to automatically move laterally with said repositionable stapler.

* * * * *